US005720116A

United States Patent [19]

Yokomizo

[11] Patent Number: 5,720,116

[45] Date of Patent: Feb. 24, 1998

[54] APPARATUS FOR DRYING AND HEATING COAL TO BE CHARGED TO COKE OVEN

[75] Inventor: Masahiko Yokomizo, Futtsu, Japan

[73] Assignee: The Japan Iron and Steel Federation, Tokyo, Japan

[21] Appl. No.: 539,462

[22] Filed: Oct. 5, 1995

[30] Foreign Application Priority Data

Oct. 12, 1994 [JP] Japan ..... 6-246126

[51] Int. Cl.[6] ..... F26B 3/08

[52] U.S. Cl. ..... 34/359

[58] Field of Search ..... 34/359, 360, 576; 432/58

[56] References Cited

U.S. PATENT DOCUMENTS

| | | | |
|---|---|---|---|
| 2,819,890 | 1/1958 | Rosa et al. | 34/576 |
| 4,010,551 | 3/1977 | Rohde | 34/57 R |
| 4,241,513 | 12/1980 | Rohde | 34/371 |
| 4,604,165 | 8/1986 | Calderon | 202/113 |
| 4,720,262 | 1/1988 | Dürr et al. | 432/106 |
| 4,762,148 | 8/1988 | Marui et al. | 137/808 |
| 5,176,489 | 1/1993 | Schroter | 414/587 |

FOREIGN PATENT DOCUMENTS

| | | | |
|---|---|---|---|
| 52-152901 | 12/1977 | Japan . | |
| 55-43200 | 3/1980 | Japan . | |
| 52-283850 | 12/1987 | Japan . | |
| 551495 | 6/1977 | U.S.S.R. | 432/58 |

*Primary Examiner*—Henry A. Bennett
*Assistant Examiner*—Dinnatia Doster
*Attorney, Agent, or Firm*—Kenyon & Kenyon

[57] ABSTRACT

In a sloped tower type airborne drying and heating apparatus, a bulge or a neck is provided at at least one location in the inner wall of a sloped pipe for the purpose of reducing in a range of 3 to 50% the cross-section of a flow path in the pipe. Coal charged into the pipe is smoothly conveyed through the sloped pipe without dwelling in the lower portion of the pipe cross-section and thus effectively dried and heated.

10 Claims, 5 Drawing Sheets

1
2
3
4-1
4-2
4-3
5
θ
1B
1C
1D 1
2
3
5
6-1
6-2
6-3
2B
2C
2D 7-3
3D
7-2
3C
3
7-1
3B
5
2
1
L1
L2
L3
5
7-1
5
7-2
5
7-3

APPARATUS FOR DRYING AND HEATING COAL TO BE CHARGED TO COKE OVEN

BACKGROUND OF THE INVENTION

1. Field of the Invention

The present invention relates to an apparatus for removing moisture contained in coal to be charged to a coke oven and preheating the coal, particularly to a sloped tower type airborne drying and heating apparatus.

2. Description of the Prior Art

Coal to be charged to a coke oven has a moisture in a range from 7% to 10% when the same is delivered from a coal yard, as a result of a rinsing process at a coal mine site and a natural seasoning through solar evaporation and a moisture increase due to rainfall while being stored in the coal yard. There are many advantages in industrial use if the moisture contained in coal is reduced prior to being charged to the coke oven to nearly 0% and the coal is preheated to a temperature of about 200° C.

That is, if the coal moisture content is reduced to nearly 0%, the heat energy consumed in a carbonization process in a coke oven can be minimized. If there is any moisture, it must be evaporated prior to the carbonization of coal with the consumption of heat energy. Further, since the evaporated moisture is heated in the upper area of the carbonization chamber, prior to being discharged from a carbonization chamber in a coke oven, the temperature of the moisture rises to as high as 700° C., which causes a large loss of heat. If such an excessive heat energy could be saved, the carbonization of coal would be facilitated because a lower oven temperature is sufficient for the same carbonization time, which in turn reduces the heat radiation from the oven and the heat in the discharged gas and thereby enables the heat energy necessary for the carbonization to be minimized.

Also, many advantages result from heating coal prior to being charged to the coke oven at heat-up rate of 1,000° C./min or more in a temperature range higher than 300° C. and lower by 30° C. than an initial softening/melting point of coal. That is, for example, if coal is heated to about 400° C. at such a high heat-up rate that a morphological change occurs in a microstructure of coal due to rise of temperature but cannot lead to the stabilized state the morphological change, the inner-particle behavior of active components is accelerated to enhance the binding property of coal.

On the other hand, to charge the preheated or heated coal into the coke oven, it is necessary to convey the same to a location higher than the coke oven generally by a height of 20 m or the like. As means for preheating and heating coal and conveying the same to a location higher than the coke oven, airborne preheating and heating apparatuses have been known.

Of these apparatuses, a sloped tower type airborne preheating and heating apparatus has, as shown in FIG. 5, a sloped pipe 25 having a diameter in a range from several tens of centimeters to several meters, which is located at a height in a range from 20 m to 50 m, wherein coal particles are conveyed to a location higher than the coke oven while being dried and heated (see Japanese Examined Utility Model Publication (Kokoku) No. 62-34988). According to the apparatus shown in FIG. 5, the coal powder fed to a coal feeding hopper 13 is preliminary dried and heated in a vertical tower 12 while blowingly conveyed upward by a carrier gas, and then separated from the carrier gas in a coal collector 14. The carrier gas is fed to a hot gas furnace 15 via a carrier gas recovery pipe 17. The separated coal powder is again fed to another vertical tower 11 from underside and blowingly conveyed upward by the carrier gas charged from the hot gas furnace 15. Then the coal powder reaches a coal collector 24 provided above the coke oven via a sloped tower 25, in which collector the coal powder is separated from the carrier gas. The separated carrier gas returns to the vertical tower 12 via the carrier gas recovery pipe 27, and the separated coal powder is fed to a coal storage tank and charged into the coke oven 21 by means of a coal charging carriage. There are sloped tower type airborne preheating and heating apparatuses other than that illustrated in FIG. 5, such as one having a single sloped tower in which the vertical tower 11 and the sloped tower 25 in FIG. 5 is combined.

This sloped tower type airborne preheating and heating apparatus has an advantage compared to an apparatus including solely vertical towers in that the preheating and heating unit can be installed at a site remote from the coke oven. This is because it is difficult in many cases to dispose the coal preheating and heating unit in the vicinity of the coke oven, since large moving machines are often arranged on the extruder side and the guide carriage side of the coke oven and, while avoiding the interference with a moving range thereof, disposal gas treating facilities are installed.

However, when the sloped pipe in this sloped tower type airborne preheating and heating apparatus inclines at an angle of 3° or more relative to a vertical axis, a hot carrier gas for preheating and heating coal tends to flow in the upper area of the pipe cross-section, while a coal powder tends to flow in the lower area thereof (a solid-gas two-phase separation phenomenon wherein coal and gas separately flows in two phases), or the gas tends to flow faster through an area in the tower wherein a content of coal powder is lower and tends to dwell in an area wherein a content of coal powder is higher (a phenomenon wherein the gas flows solely through part of the pipe cross-section).

Such states are a so-called channelling phenomenon wherein the distribution of gas flow speed becomes uneven in the pipe cross-section, which in turn causes the uneven distribution of coal powder content in the carrier gas.

Particularly, in an apparatus with a sloped pipe which length exceeds ten times a pipe diameter, if a flow speed of a carrier gas is low, if the inclination of the sloped pipe is 10° or more, or if an average particle size is large, unevenness of the distribution of gas flow speed increases in the pipe cross-section, whereby the channelling phenomenon becomes significant. According to this channelling phenomenon, it is difficult to uniformly disperse coal powder in the pipe cross-section to be capable of rising up, and sometimes the coal powder may dwell midway of the pipe and deposit therein. As a result, not only the heating efficiency of the preheating and heating unit is lowered, but also other problems may occur, such as the increase in an amount of carrier gas, the variation of coal properties due to the dwell time of coal powder in this system, the increase in an electric power cost, the abrasion of the sloped pipe wall or confusion in a pressure control system.

To mitigate such states, it is conceivable to increase the gas flow speed. This solution, however, pushes up the operation cost, while there is no significant improvement in the uniformity of conveying capacity. As a result, the contact between gas and coal powder becomes uneven, which causes the reduction of heat transfer rate and also of heat efficiency due to the insufficient rise of the coal temperature or the discharged gas temperature.

The present invention has been made based on various studies to solve the above-mentioned problems.

SUMMARY OF THE INVENTION

An object of the present invention is to prevent a solid-gas two-phase separation phenomenon or a gas flow-through phenomenon; i.e., a channelling phenomenon.

To achieve this object, according to the present invention, a sloped tower type airborne drying and heating apparatus is provided, wherein coal to be charged to a coke oven as a raw material is dried to remove moisture contained therein and then further heated while being conveyed obliquely upward with a hot carrier gas through a sloped pipe having an inclination angle of 3° or more relative to a vertical axis, characterized in that, at least one location of the sloped pipe, an inner-bulge, i.e., a protrusion formed on the inner wall of the pipe, or a neck, i.e., a constriction formed by squeezing down the pipe itself, is provided for reducing the cross-section of a flow path in the pipe.

In the pipe portion reducing the cross-section of the flow path thus formed, a flow speed of gas increases and a flowing direction (a rising angle) of coal and gas can be changed directly by the inner-bulge or the like. Accordingly, the flow of gas and coal is disturbed by the inner-bulge or the neck to minimize the unevenness in the distribution of gas, flow speed, whereby there is no tendency of dwell or deposition of coal in the midway of pipe but the coal can be uniformly dispersed in the pipe cross-section and smoothly conveyed upward.

When the pipe cross-section is reduced by the inner-bulge or the neck, a so-called shrinking flow phenomenon tends to occur wherein the dwell of gas flow speed occurs in the pipe directly behind the reduced cross-sectional portion, causing an adverse effect such as the increase in a resistance to flow or the dwell of flow. Particularly, if half a pipe cross-section or more is blocked so that the gas flow speed increases four times or more, the adverse effect is significant due to contraction.

Accordingly, it is desired to limit the areal reduction ratio of the pipe cross-section to at most ½. On the other hand, the lower limit of the areal reduction ratio of the pipe cross-section due to the inner-bulge is determined in accordance with the inclination angle of the heating tower. That is, the inner-bulge may be smaller if the inclination angle in the pipe is less, while if the inclination angle of the heating tower becomes larger; i.e., nearer to horizon, the inner-bulge must be enlarged accordingly. Therefore, it is necessary that the areal reduction ratio of the pipe cross-section is 3% or more so that the cross-sectional area after reduction is 97% or less of the original.

Further, although it is possible to disturb flows of gas and coal by the inner-bulge or the neck and improve the unevenness of the distribution of gas flow speed, this flow disturbance appears only in a region starting from the reduced cross-sectional portion to a position distant therefrom about ten times an inner diameter of the sloped pipe. Downstream of this region, the unevenness of the distribution of gas flow restores to the original level. In other words, if a distance between two adjacent inner-bulges (or necks) exceeds ten times the inner diameter of the sloped pipe, coal particles tend to dwell therebetween, resulting in the irregularity of coal powder content in a carrier gas. Accordingly, it is favorable to provide the reduced cross-sectional portions at a pitch corresponding to ten times the inner diameter of the sloped pipe or less. Contrarily, if the pitch is less than three times the inner diameter of the sloped pipe, the resistance to flow becomes larger to deteriorate the conveying capacity. Therefore, the reduced cross-sectional portion is provided preferably at a pitch in a range from three to ten times the inner diameter of the slanted pipe.

An alternate arrangement of the inner-bulges or the neck is preferable for effectively disturbing the flow of gas and coal and improving the unevenness of the distribution of gas flow speed, wherein, for example, one inner-bulge is attached onto the lower side of the pipe cross-section and next is onto the upper side so that the respective inner-bulges are alternately located on the opposite positions.

The gas temperature falls as the moisture contained in coal is dried and heated, and simultaneously therewith, the gas volume falls. Accordingly, there is a problem in that the flow speed of gas falls as the gas rises up the sloped pipe. The temperature drop in the airborne drying and heating apparatus is generally in a range from 5% to 30% for a pipe length corresponding to ten times the pipe inner diameter, although it varies in accordance with a thermal capacity coefficient inherent to the apparatus or a heat transfer efficiency in the acceleration area. As a result, when the gas is introduced into the lower part of the pipe at a temperature of 600° C., the flow speed of gas at the upper part of the pipe reduces to 97% through 80% of that in the lower part, which also causes the dwell of coal powder or the like.

To compensate for the fall in gas temperature, it is possible to stepwisely or continuously reduce the pipe cross-section in the upward direction, for example, by using a sloped pipe tapered upward. When the size of coal particles is small, a heat exchange promptly occurs due to the contact between coal and gas, whereby the temperature of coal particle significantly rises and that of gas lowers. Also when the difference between temperatures of coal and gas is large, a heat transfer rate tends to be higher. Accordingly, the temperature difference between the lower and upper parts of the sloped pipe is variable in cases and, as a result, the gas flow speed also variously changes. However, in a particular case wherein a length of the sloped pipe is larger than ten times the pipe inner diameter and coal is heated to 400° C., the gas temperature lowers from 600° C. to 450° C. and the gas flow speed reduces to about 80%. Or, if coal is heated to 200° C., the gas temperature falls from 450° C. to 250° C. and the gas flow speed falls to about 75%. Accordingly, the sloped pipe tapered upward is preferably used, wherein the cross-sectional area of the pipe exit is in a range from 75% to 80% of the cross-sectional area of the pipe entrance.

Provision of the above-mentioned inner-bulge or neck is also effective for locally reducing the pipe cross-sectional area so that the irregularity of the distribution of gas flow speed is improved. That is, the inner-bulges may be formed in a discrete manner in the sloped pipe tapered upward.

Configurations of the inner-bulge may be a hill type or a trapezoidal cross-section type. The hill type is more effective for intermittently disturbing flows of coal and gas, while, industrially, the trapezoidal cross-section type is more advantageous in restricting trouble during the operation due to abrasion.

DESCRIPTION OF THE PREFERRED EMBODIMENTS

Figures 1A, 1B, 1C, 1D:
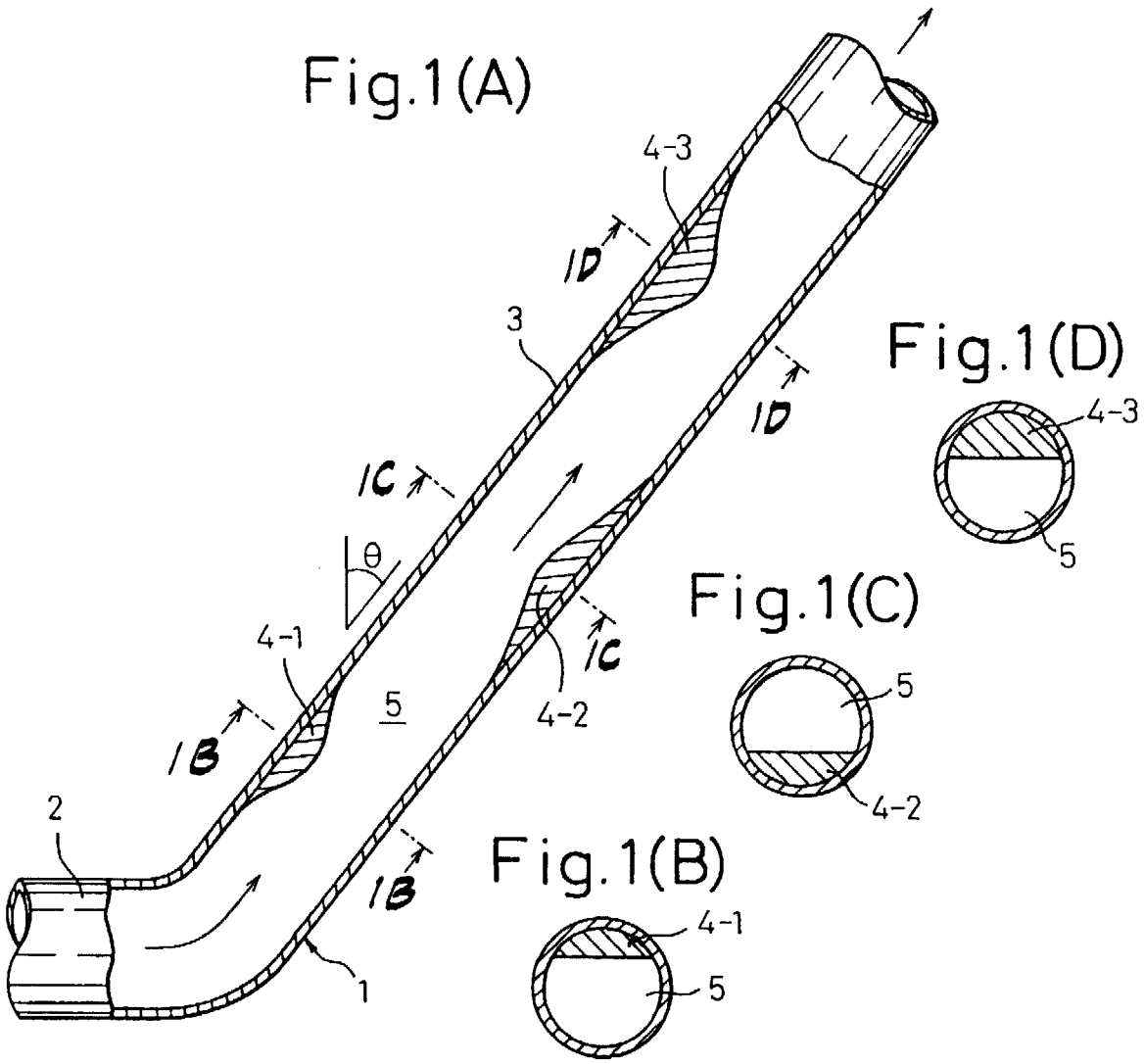
FIG. 1(A) is a partial sectional view of one embodiment of the present invention wherein a hill type inner-bulge is illustrated.
FIG. 1(B) is a cross-section taken along line b—b in FIG. 1(A)
FIG. 1(C) is a cross-section taken along line c—c in FIG. 1(A)
FIG. 1(D) is a cross-section taken along line d—d in FIG. 1(A)

One embodiment of the present invention will be described in more detail with reference to FIGS. 1(A) through 1(D). FIG. 1(A) is a partial sectional view of a sloped pipe 1 in a sloped tower type airborne preheating and heating apparatus, wherein a hill-shaped inner-bulge 4-1 having a gentle inclination is provided on the upper side of the pipe inner wall at a location directly downstream of a bend of the pipe at which a horizontal section 2 of the pipe 1 (this horizontal section 2 is connected with a vertical tower flowing a carrier gas) is merged into a rising section 3. As shown in FIG. 1(B), the inner-bulge 4-1 partially blocks the upper region of a flow path 5 for gas and coal so that the area of the flow path 5 in the pipe cross-section (taken along a plane vertical to the longitudinal axis of the slope pipe) is reduced.

Next, a second inner-bulge 4-2 having a configuration similar to that of the inner-bulge 4-1 and a height slightly larger than that of the former is provided on the lower side of the pipe inner wall adjacent to the inner-bulge 4-1. As shown in FIG. 1(C), the inner-bulge 4-2 partially blocks the lower region of the flow path 5 for gas and coal so that the area of the flow path 5 in the pipe cross-section is more reduced than in the former inner-bulge 4-1.

Further, a third inner-bulge 4-3 having a configuration similar to that of the second inner-bulge 4-2 and a height slightly larger than that of the former is provided on the upper side of the pipe inner wall adjacent to the inner-bulge 4-2. As shown in FIG. 1(D), the inner-bulge 4-3 blocks almost the upper half of the flow path 5 for gas and coal so that an area of the flow path 5 in the pipe cross-section is even more reduced than in the preceding inner-bulges. According to the above arrangement, the sloped pipe 1 is capable of increasing the gas flow speed as the gas rises upward through the pipe whereby coal is blowingly conveyed upward while avoiding the dwell of coal from occurring on the upper or lower side of the pipe inner wall.

Figures 2A, 2B, 2C, 2D:
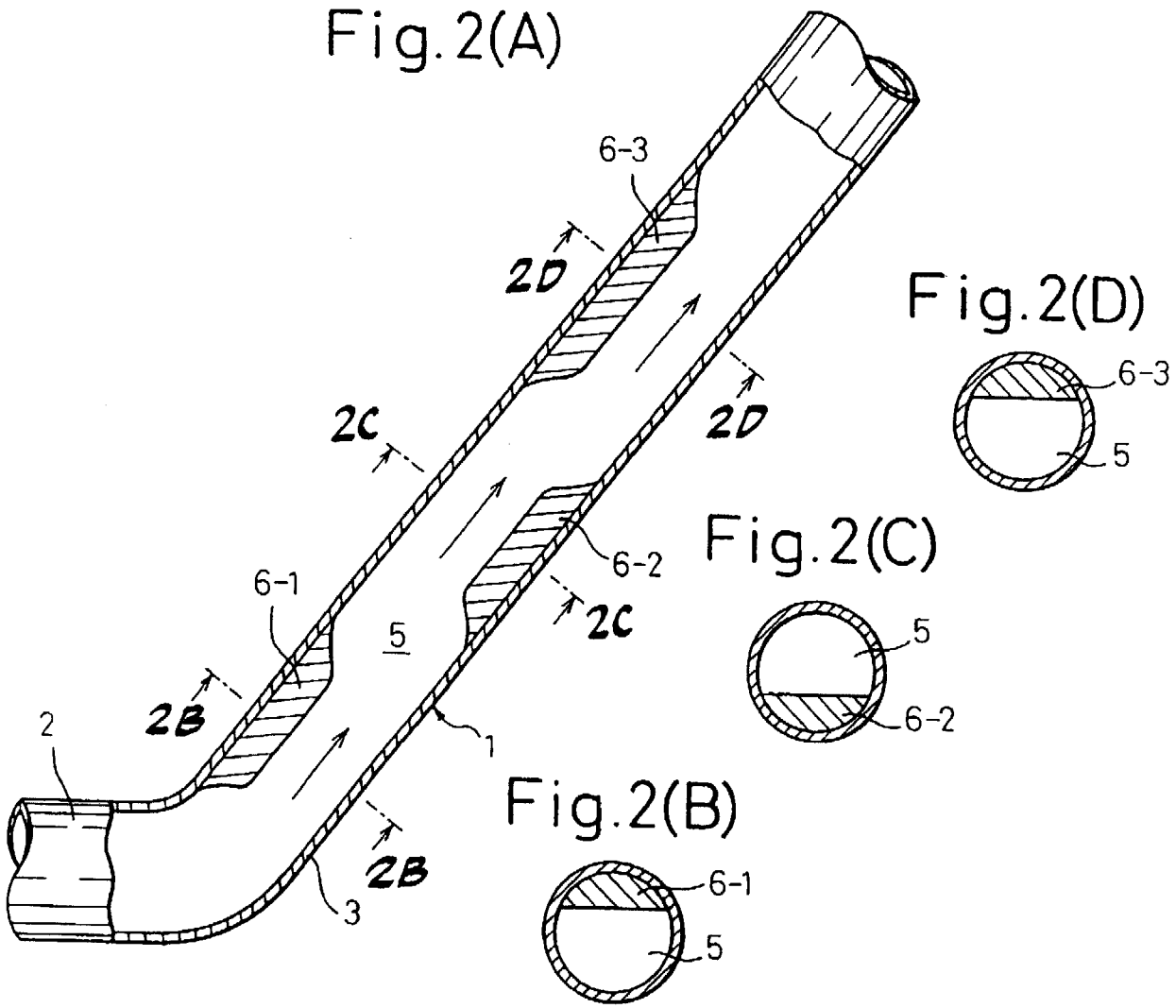
FIG. 2(A) is a partial sectional view of another embodiment of the present invention wherein a trapezoidal cross-section type inner-bulge is illustrated.
FIG. 2(B) is a cross-section taken along line b—b in FIG. 2(A)
FIG. 2(C) is a cross-section taken along line c—c in FIG. 2(A)
FIG. 2(D) is a cross-section taken along line d—d in FIG. 2(A)

Another embodiment will be described below with reference to FIGS. 2(A) through 2(D). FIG. 2(A) illustrates a sloped pipe provided with inner-bulges 6-1 through 6-3 having a trapezoidal cross-section and alternately arranged on the upper and lower sides of the pipe inner wall. In this embodiment, as shown in FIGS. 2(B) through 2(D), heights of the respective inner-bulges measured from the pipe inner wall are substantially the same to each other so that the turbulence occurs in the gas flow to minimize the unevenness of the distribution of gas flow speed.

Figures 3A, 3B, 3C, 3D:
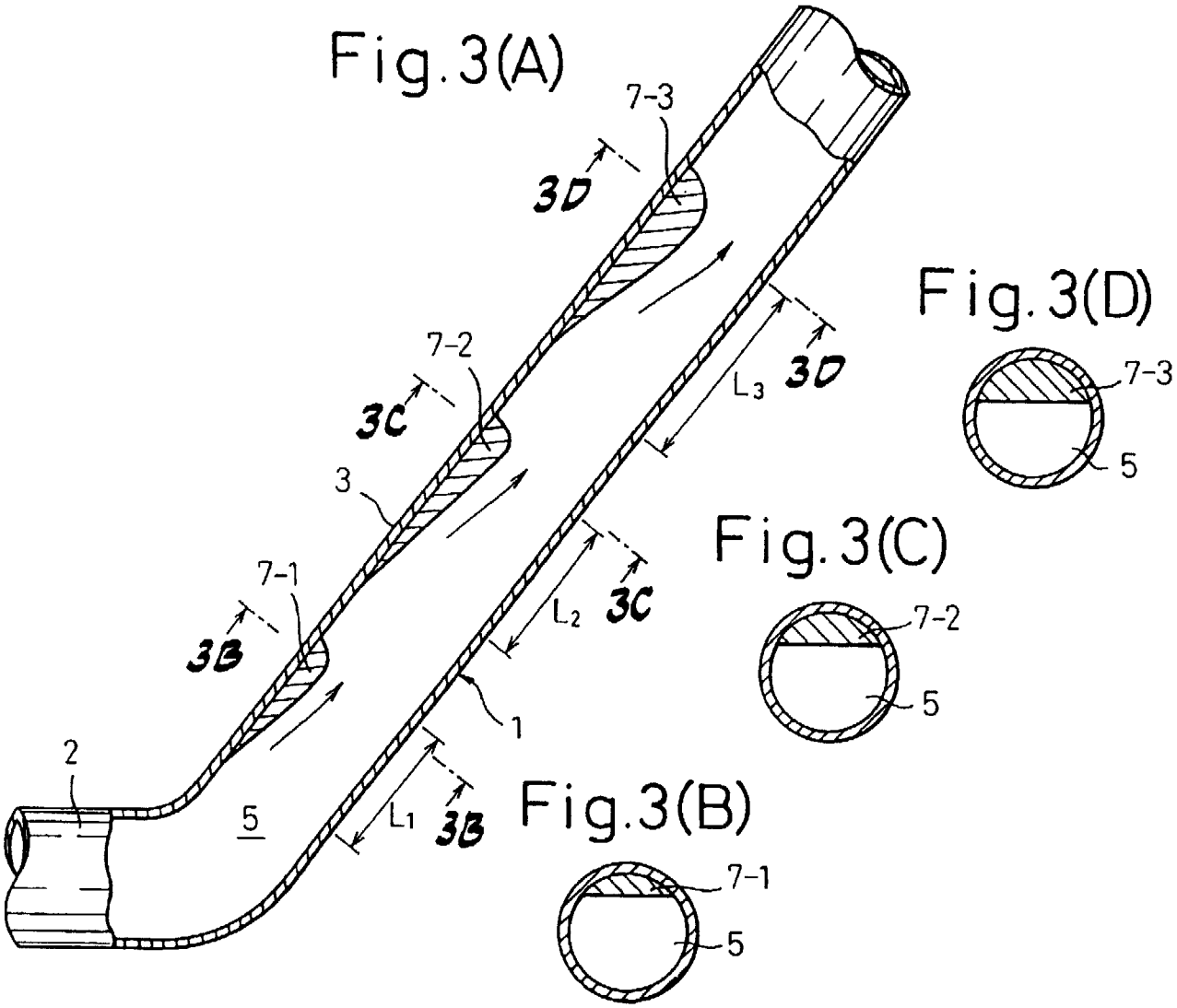
FIG. 3(A) is a partial sectional view of further embodiment of the present invention wherein a tear-drop type inner-bulge is illustrated.
FIG. 3(B) is a cross-section taken along line b—b in FIG. 3(A)
FIG. 3(C) is a cross-section taken along line c—c in FIG. 3(A)
FIG. 3(D) is a cross-section taken along line d—d in FIG. 3(A)

FIGS. 3(A) through 3(D) illustrates a sloped pipe provided with inner-bulges 7-1, 7-2 and 7-3 having a tear-drop cross-section and arranged solely on the upper side of the pipe inner wall. As shown in FIG. 3(A), the tear-drop type inner-bulge is shaped to have a slope of a smaller inclination reaching a peak in the flowing direction of gas, which then returns the pipe inner wall at a larger inclination so that a gently sloped asymmetric hill shape is formed. The inner-bulges are arranged so that the peak thereof becomes higher as the inner-bulge is located higher in the sloped pipe.

Different from the conventional method wherein a propelling force is imparted to coal particles in the direction different from that of the inertial force, these embodiments are aimed to disturb the flowing state and generate turbulence by reducing the pipe cross-section in the above manner so that the flow speed of hot carrier gas is intermittently accelerated and decelerated and vortices are formed directly behind the reduced cross-sectional portion. The intermittent acceleration/deceleration of gas flow speed is effective for avoiding the dwell of coal particles and creating an active state in which the coal particles are always stirred. Also, according to such a reduced cross-sectional portion, the relative speed of carrier gas to coal particles increases, whereby the conveying speed of coal particles is accelerated. This method has a large advantage in the simplification of installation.

Figure 4:
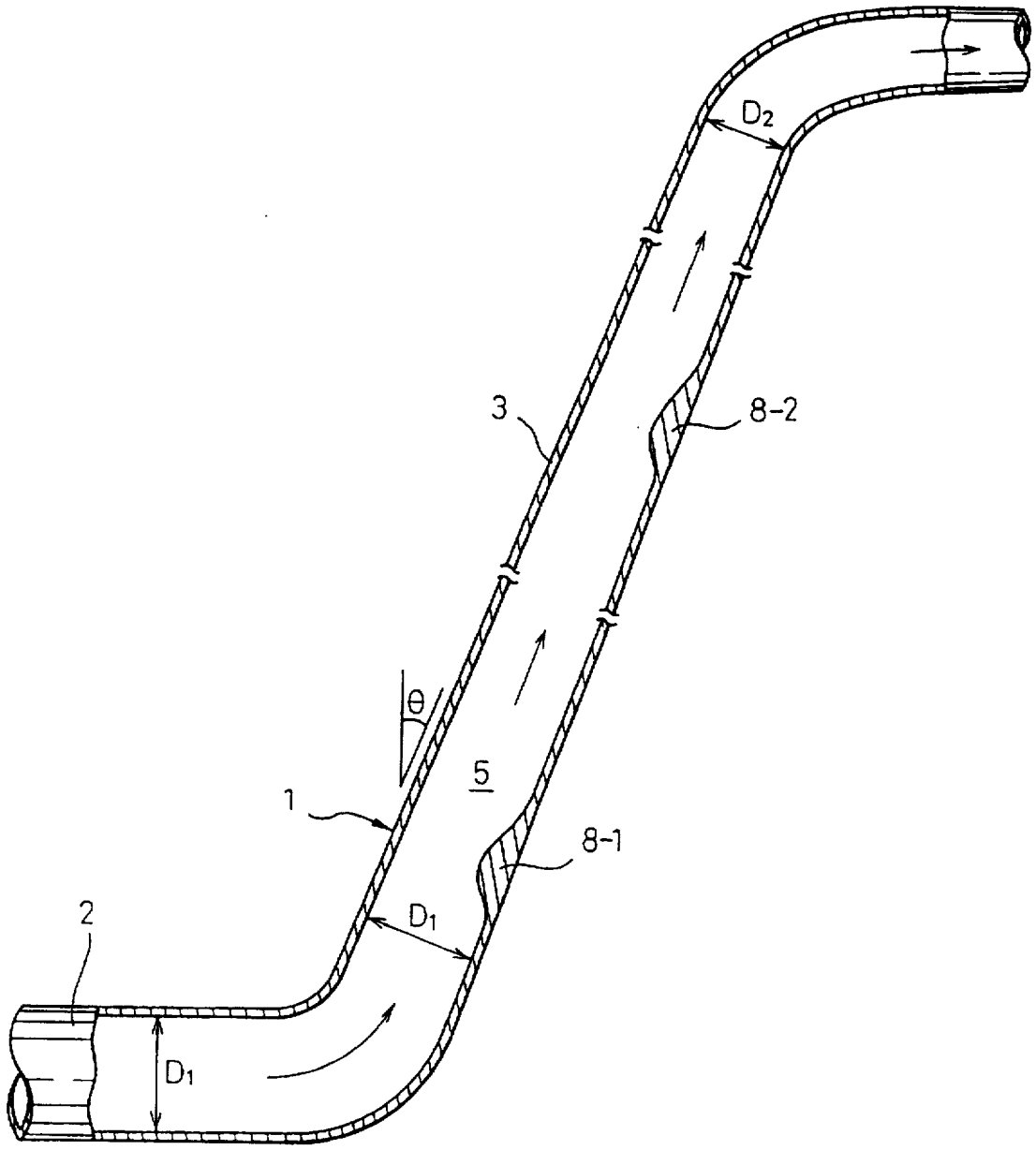
FIG. 4 is a partial sectional view of still further embodiment of the present invention wherein inner-bulges are provided in a sloped pipe tapered upward.
Figure 5:
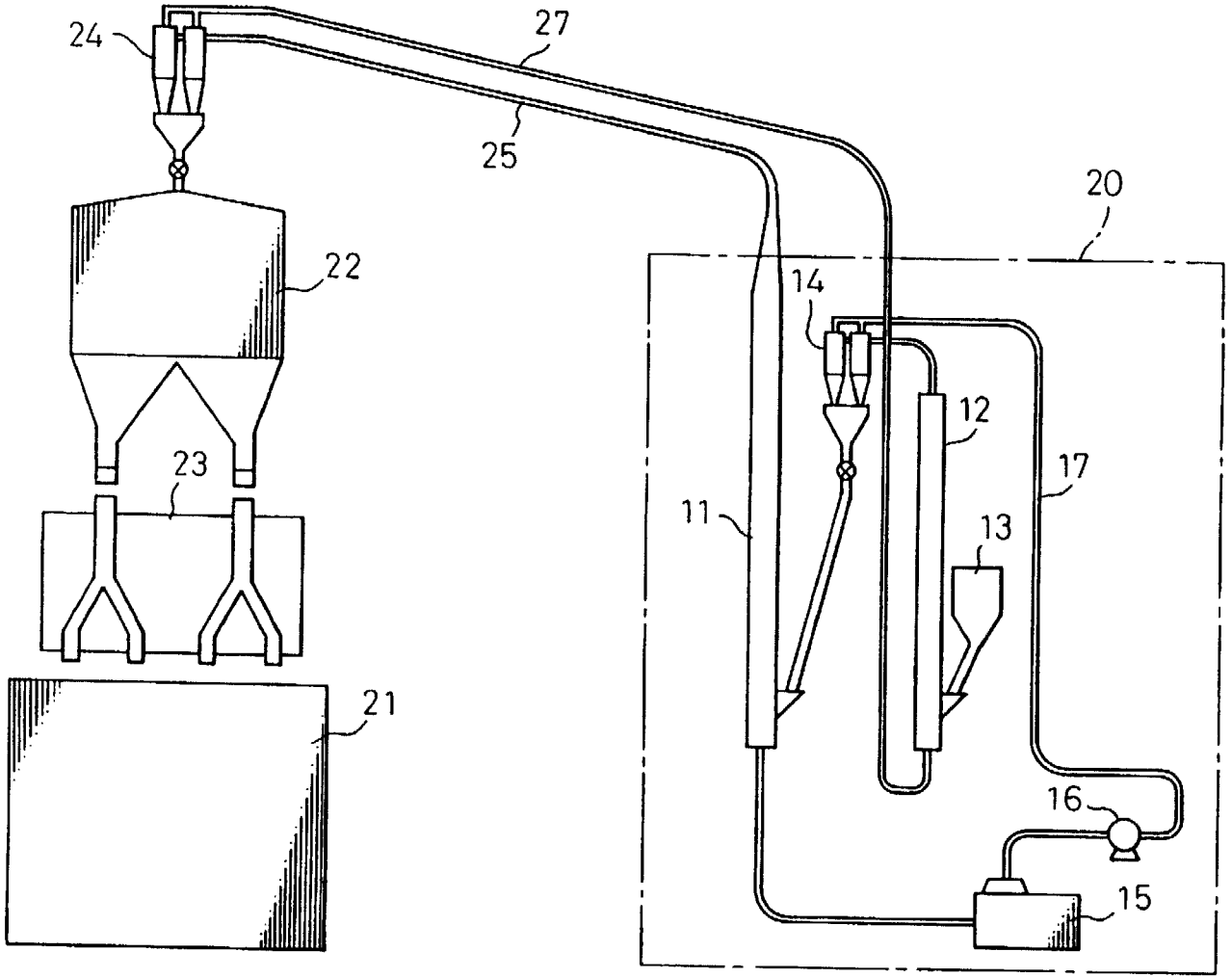
FIG. 5 is a schematic front view of a prior art sloped tower type airborne preheating and heating apparatus.

According to further embodiment shown in FIG. 4, a sloped pipe 1 is continuously tapered upward so that the inner diameter D1 of an entrance of the sloped pipe which is equal to the inner diameter of a horizontal section 2 is larger than the inner diameter D2 of an exit of the sloped pipe (the exit is connected with a coal collector), and provided with hill-shaped inner-bulges 8-1 and 8-2 on the lower side of the inner wall thereof. In this regard, a taper of the sloped pipe is selected while taking the reduction of gas flow speed into account, which is a function of a pipe length and/or a coal heating temperature.

EXAMPLE 1

Coal to be charged to a coke oven having a moisture content of 9% was heated to 200° C. through a sloped tower type airborne drying and heating apparatus having a sloped pipe shown in FIG. 1(A) at a production rate of 100 ton/hour. A sloped pipe was of a circular cross-section having a diameter of 1.3 m, and a gas flow speed was selected at 30 m/sec at 300° C. Since a distance between the sloped tower type airborne drying and heating apparatus and a charging/discharging device of a coke oven was about 25 m, the sloped pipe was installed at a height of 50 m with an inclination angle θ of 30°. Particle conditions of coal were substantially the same as those of normal coal and controlled so that coal particles having a particle size of 3 mm or less is within a range of 85%±10% and the upper limit size is 10 mm. In this regard, particles having a size exceeding the upper limit were crushed to have the predetermined size.

Coal was fed to the sloped pipe by a rotary feeder from a horizontal section 2 provided in the lower portion of the sloped pipe, and dried and heated, while being blowingly conveyed upward, with hot air. The pipe cross-section was basically circular with a diameter of 1.3 m but changed in a portion starting from directly downstream of a bend of the pipe at which the horizontal section 2 of the pipe 1 is merged into a rising section 3. First, an inner-bulge 4-1 was provided on the upper side of the pipe inner wall so that a reduced cross-sectional portion having a length of 1.8 m is provided along the inner wall, by which the upper side of the pipe inner wall is gently curved as shown in FIG. 1(B). That is, in the pipe cross-section taken along a plane including the peak of the inner-bulge 4-1, a height of the peak was 40 cm and the configuration of a gas-coal flow path 5 was of a partially cut circle as shown in FIG. 1(B). Thus, a substantial area of the pipe cross-section was reduced to 75% in the vicinity of the peak of the inner-bulge 4-1.

Next, a second inner-bulge 4-2 was provided on the lower side of the pipe inner wall at a position distant by 5 m from the first inner-bulge (this distance 5 m corresponds to 3.8 times the pipe inner diameter) so that the pipe cross-section is reduced.

Further, a third inner-bulge 4-3 was provided on the upper side of the pipe inner wall at a position distant by 5 m from the second inner-bulge. A height of a peak of the inner-bulge 4-3 was 65 cm (about a half of pipe diameter).

Coal fed to the sloped pipe thus structured could be blowingly conveyed upward without causing a dwell in the lower portion of the pipe as well as forming a deposit layer on the lower region of the pipe cross-section although the resistance to flow increased by 5% or so. Simultaneously therewith, drying and heating, to 200° C., of the coal were also achieved at a heat-transfer efficiency higher by 10% than that in the conventional method.

EXAMPLE 2

Normal temperature coal having a moisture content of 5% and crushed to have a particle size of 3 mm or less was treated by a sloped tower type airborne drying and heating apparatus having a sloped pipe shown in FIG. 3(A). The sloped pipe of this apparatus had a circular cross-section, of which inner diameter is 0.6 m, and was installed at a height of 50 m at an inclination angle of 15°.

Tear-drop shaped inner-bulges 7-1 through 7-3 were provided at a 4 m pitch (corresponding to 6.7 times the pipe inner diameter) on the upper side of the pipe inner wall. An average length of the respective inner-bulges measured along the pipe wall was 1 m (corresponding to an acceleration zone L) and an average height of peaks of the respective inner-bulges in the pipe cross-section was 200 mm, while the substantial areas of the pipe cross-sections were reduced to 92%, 85% and 75%, respectively, at the locations of the respective inner-bulges.

In the above apparatus, the above-mentioned coal was fed to the sloped pipe together with a rising gas flow so that a solid-gas ratio by mass of 0.7 is obtained. The coal was smoothly conveyed through a 15 m length of the sloped pipe and reached the state wherein the moisture content was 0% and the coal temperature was 130° C.

EXAMPLE 3

Normal temperature coal having a moisture content of 5% and crushed to have a particle size of 3 mm or less was treated by a sloped tower type airborne drying and heating apparatus having a sloped pipe shown in FIG. 4. The sloped pipe 1 of this apparatus was tapered upward so that an inner diameter D1 of an entrance thereof is 0.6 m and D2 of an exit thereof is 0.52 m. The pipe 1 was 15 m long and installed at an inclination angle θ of 15°. The areal reduction ratio of the cross-section of the pipe exit to that of the pipe entrance was about 75%, which was sufficient for restricting the reduction of the gas flow speed due to the cooling of carrier gas.

Moreover, inner-bulges 8-1 and 8-2 were provided on the lower side of the inner wall of the sloped pipe at a 3 m distance corresponding to five times the inner diameter of the pipe entrance, as shown in FIG. 4. The substantial area of the pipe cross-section caused by the respective inner-bulge was 85% of the pipe cross-section without the inner-bulge.

In the above apparatus, the above-mentioned coal was fed to the sloped pipe together with a rising gas flow having a flow speed of 30 m/sec and a temperature of 450° C. so that a solid-gas ratio by mass of 0.7 is obtained. The coal was smoothly conveyed through a 15 m length of the sloped pipe and the gas temperature reached to 270° C. at the pipe exit.

COMPARATIVE EXAMPLE 1

A test was conducted by the apparatus used in Example 2 while partially blocking the pipe so that the substantial area of the pipe cross-section was 50% or less by providing inner-bulges having peaks of 300 mm to 350 mm high in the inner wall of the pipe at an entrance thereof having an inner diameter of 0.6 m. The calculated pressure drop in this section was 60 mm Aq and a blower was set to have a discharging capacity to overcome this pressure drop. However, since the resistance to flow was actually higher than the estimated value, an aimed amount of circulation gas could not be maintained. In addition, vibration was generated over the length of pipe and was assumed to be caused by the inner-pipe pulsation. Therefore, the test was interrupted for the sake of the safety of the apparatus. To solve these problems, the inner-bulges were replaced to those having a smaller peak height so that the substantial area was more than 50%. A test conducted by this modified apparatus showed that the vibration over the length of pipe is minimized, a stable operation is obtained and the amount of circulation gas was restored to an aimed level.

COMPARATIVE EXAMPLE 2

In the apparatus used in Example 2, the sloped pipe was modified so that the inner-bulges are disposed at a larger pitch of 9 m corresponding to fifteen times the pipe inner diameter. It has been said that the inner-pipe turbulent effect varies in accordance with the inner-bulge configurations; for example, the steeper the slope of the inner-bulge, the larger the contraction effect, and the higher the inner-bulge peak, the larger the turbulent effect in the downstream of the pipe. A test was conducted, while maintaining such conditions constant, for reducing the resistance to flow in the pipe by prolonging the inner-bulge pitch as described before. As a result, the resistance to flow became smaller but the heat-transfer efficiency is also lowered which is supposed to be due to the uniform dispersion property of coal particles in the pipe and the unevenness in gas flow, whereby the gas temperature at the sloped pipe exit is higher by 30° C. and the coal temperature at the pipe exit is 115° C. which is lower by 15° C. compared to the well-dispersed state.

COMPARATIVE EXAMPLE 3

In the apparatus used in Example 2, the sloped pipe was modified so that the inner-bulges are disposed at a smaller pitch of 1.2 m corresponding to twice the pipe inner diameter. A test showed that the turbulent effect is significantly enhanced and the resistance to flow also increases. The actual pressure drop was 90 mm Aq in this section which is higher than the assumed value of 60 mm Aq, whereby the period of vibration over the length of the pipe became shorter and the amplitude thereof was somewhat larger.

We claim:

1. A sloped tower type airborne drying and heating apparatus wherein coal to be charged to a coke oven as a raw material is dried to remove moisture contained therein and then further heated while being conveyed obliquely upward through a sloped pipe having an inclination angle of 3° or more relative to a vertical axis with a hot carrier gas, wherein at at least one location of the sloped pipe, an inner-bulge or a neck is provided so that a cross-sectional area of a flow path in the pipe taken along a plane perpendicular to the pipe axis and including a peak of the inner-bulge or the neck is reduced by 3% through 50% of a cross-sectional area of the sloped pipe without the inner-bulge or the neck, at the same position as the cross-sectional area including the peak of the inner-bulge or the neck, wherein a plurality of the inner-bulges or the necks are arranged at a distance from the adjacent one, corresponding to three through ten times the inner diameter of the sloped pipe.

2. An apparatus as defined by claim 1, wherein at least one of the plurality of the inner-bulges or the necks has a hill shape.

3. An apparatus as defined by claim 1, wherein at least one of the plurality of the inner-bulges or the necks has a trapezoidal cross-section shape.

4. An apparatus as defined by claim 1, wherein at least one of the plurality of the inner-bulges or the necks has a tear-drop shape.

5. An apparatus as defined by claim 1, wherein the plurality of the inner-bulges or the necks are arranged so that a peak of the respective inner-bulge or the neck is sequentially higher as the location thereof is an upper part of the sloped pipe.

6. An apparatus as defined by claim 1, wherein the plurality of the inner-bulges or the necks are alternatively arranged on the upper and lower sides of the inner wall of the sloped pipe.

7. An apparatus as defined by claim 1, wherein the plurality of the inner-bulges or the necks are arranged in series on the upper side or lower side of the inner wall of the sloped pipe.

8. An apparatus as defined by claim 1, wherein the sloped pipe is tapered upward.

9. A sloped tower type airborne drying and heating apparatus wherein coal to be charged to a coke oven as a raw material is dried to remove moisture contained therein and then further heated while being conveyed obliquely upward through a sloped pipe having an inclination angle of 3° or more relative to a vertical axis with a hot carrier gas, wherein at at least one location of the sloped pipe, an inner-bulge or a neck is provided so that a cross-sectional area of a flow path in the pipe taken along a plane perpendicular to the pipe axis and including a peak of the inner-bulge or the neck is reduced by 3% through 50% of a cross-sectional area of the sloped pipe without the inner-bulge or the neck, at the same position as the cross-sectional area including the peak of the inner-bulge or the neck, wherein a plurality of the inner-bulges or the necks are arranged at a distance from the adjacent one, corresponding to three through ten times the inner diameter of the sloped pipe, wherein the plurality of the inner-bulges or the necks are alternatively arranged on the upper and lower sides of the inner wall of the sloped pipe.

10. A sloped tower type airborne drying and heating apparatus wherein coal to be charged to a coke oven as a raw material is dried to remove moisture contained therein and then further heated while being conveyed obliquely upward through a sloped pipe having an inclination angle of 3° or more relative to a vertical axis with a hot carrier gas, wherein at at least one location of the sloped pipe, an inner-bulge or a neck is provided so that a cross-sectional area of a flow path in the pipe taken along a plane perpendicular to the pipe axis and including a peak of the inner-bulge or the neck is reduced by 3% through 50% of a cross-sectional area of the sloped pipe without the inner-bulge or the neck, at the same position as the cross-sectional area including the peak of the inner-bulge or the neck, wherein a plurality of the inner-bulges or the necks are arranged at a distance from the adjacent one, corresponding to three through ten times the inner diameter of the sloped pipe, wherein the plurality of the inner-bulges or the necks are arranged in series on the upper side or lower side of the inner wall of the sloped pipe.

* * * * *